US007644662B2

(12) United States Patent
Leblond et al.

(10) Patent No.: US 7,644,662 B2
(45) Date of Patent: Jan. 12, 2010

(54) ELASTIC RETENTION RING FOR COMBUSTIBLE CASINGS

(75) Inventors: Joel Leblond, Bourges (FR); Jacques Bachelier, Plaimpied Givaudins (FR)

(73) Assignee: Nexter Munitions, Versailles (FR)

( * ) Notice: Subject to any disclaimer, the term of this patent is extended or adjusted under 35 U.S.C. 154(b) by 4 days.

(21) Appl. No.: 12/007,105

(22) Filed: Jan. 7, 2008

(65) Prior Publication Data

US 2008/0163778 A1 Jul. 10, 2008

(30) Foreign Application Priority Data

Jan. 10, 2007 (FR) ..... 07 00148

(51) Int. Cl.
*F42B 5/26* (2006.01)
*F42B 4/18* (2006.01)

(52) U.S. Cl. ..... 102/469; 102/431; 102/700

(58) Field of Classification Search ..... 102/431, 102/432, 433, 467, 469, 700
See application file for complete search history.

(56) References Cited

U.S. PATENT DOCUMENTS 3,776,137 A * 12/1973 Abbott ..... 102/431
3,978,793 A * 9/1976 McLennan et al. ..... 102/432
4,159,678 A 7/1979 Luther et al.
4,276,830 A * 7/1981 Pastora Alice ..... 102/467
6,408,764 B1 6/2002 Heitmann et al.
6,450,099 B1 9/2002 Desgland

FOREIGN PATENT DOCUMENTS

| | | | |
|---|---|---|---|
| EP | 1 085 289 | A2 | 3/2001 |
| EP | 1 092 939 | A1 | 4/2001 |
| EP | 1 674 817 | A1 | 6/2006 |
| FR | 2 365 096 | A1 | 4/1978 |
| WO | WO 03/014654 | A1 | 2/2003 |

* cited by examiner

*Primary Examiner*—Bret Hayes
(74) *Attorney, Agent, or Firm*—Oliff & Berridge, PLC

(57) ABSTRACT

An elastic retention ring for the combustible casing of a piece of ammunition with respect to a base, the ring including two concentric substantially ring-shaped portions, one internal the other one external. The portions are linked by radial arms, and are continuous or not and have different diameters. The external portion incorporates at least one plane part and the radial arms form an angle with respect to the plane of plane part.

10 Claims, 5 Drawing Sheets

ELASTIC RETENTION RING FOR COMBUSTIBLE CASINGS

BACKGROUND OF THE INVENTION

1. Field of the Invention

The technical scope of the invention is that of means to hold the combustible casing of a piece of ammunition in place with respect to the shell base.

2. Description of the Related Art

Retention means are known by patent WO03/014654 comprising a pierced washer enabling the base to move with respect to the casing.

This washer incorporates a cup-shaped profile whose bottom matches the internal profile of the casing.

An angle is provided between a horizontal plane and the bottom of the cup so as to lend a certain rigidity to the link.

This washer, however, suffers from the drawback of generating radial stress on the combustible casing should there be any axial crushing. Such radial stress is all the prejudicial in that such a washer is somewhat rigid and risks cutting the casing.

Moreover, in the case of pre-stressed assembly, the contact surface of this washer with the bottom of the combustible casing is practically a circular line. This results in the casing bottom being embrittled thereby diminish its mechanical resistance to future stresses.

SUMMARY OF THE INVENTION

The aim of the invention is to propose an elastic retention ring which ensures the reliable retention of the base and casing whilst avoiding any radial stress on the casing and nevertheless enabling limited movements of the base with respect to the casing with minimal stressing of the casing. These limited movements enable the base to be returned to its initial position after any mechanical stressing.

Thus, the invention relates to an elastic retention ring for the combustible casing of a piece of ammunition with respect to a base, such ring wherein it comprises two concentric, substantially ring-shaped portions, linked by radial arms, such portions continuous or not, the portion of the greatest diameter incorporating at least one plane part and the radial arms forming an angle with respect to the plane of this plane part.

Advantageously, the two ring-shaped portions may be plane and parallel to each other.

According to one characteristic, the ring may incorporate an opening positioned between two consecutive arms, the external ring-shaped portion incorporating extensions extending radially in each opening.

Each extension may be pierced.

According to other embodiments, the external crown may have slots evenly spaced angularly, each slot being positioned at an equal distance from two consecutive arms.

The internal crown may have slots evenly spaced angularly, each slot being positioned at an equal distance from two consecutive arms.

According to a preferred embodiment of the invention, the external crown of the ring is separated into ring-shaped sectors, each sector being integral with an arm.

The internal crown may have a slot and it may have a hole in each side of this slot, such holes being intended to receive a tool enabling the ring to be positioned on the base.

Each ring-shaped sector may advantageously incorporate curved extremities.

BRIEF DESCRIPTION OF THE DRAWINGS

The invention will become more apparent from the following description of different embodiments, such description being made with reference to the appended drawings, in which.

DETAILED DESCRIPTION OF PREFERRED EMBODIMENTS

Figure 1:
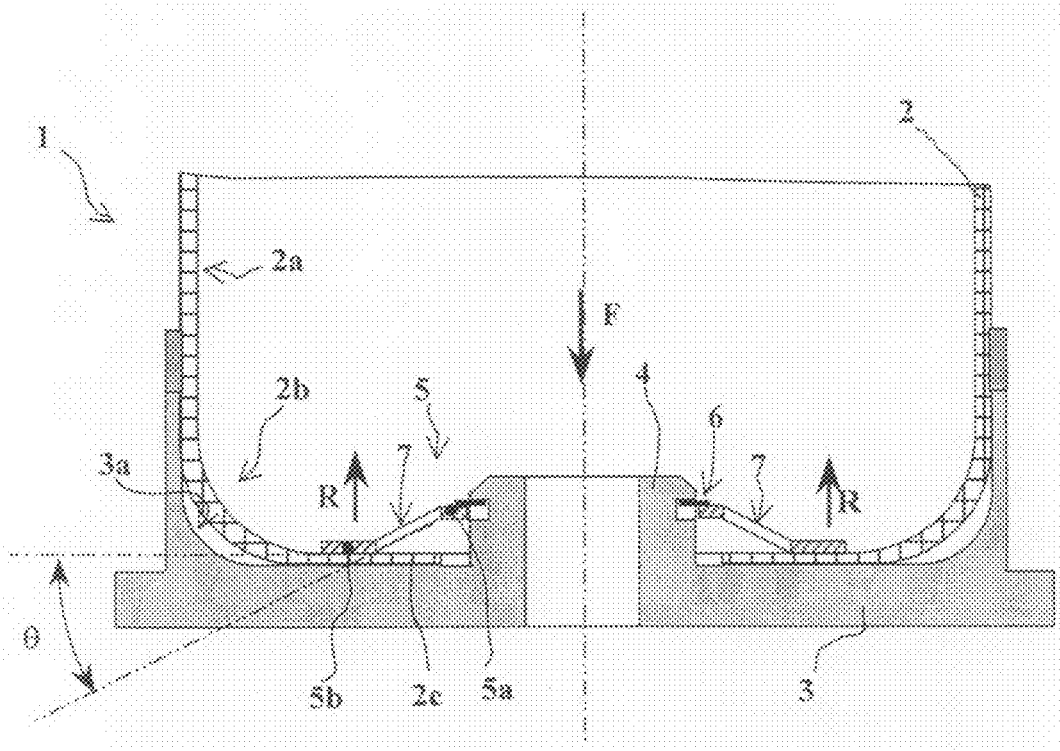
FIG. 1 is a partial longitudinal section view of the rear part of a piece of ammunition incorporating an elastic ring according to the invention.

FIG. 1 shows the rear part of a piece of artillery ammunition 1 incorporating a combustible casing 2 to which an obturating base 3 is fixed. The obturating base incorporates an axial support 4 intended to receive an igniting tube (not shown).

The combustible casing 4 comprises a cylindrical part 2*a* which is extended by a substantially plane ring-shaped bottom 2*c*. The bottom 2*c* is linked to the cylindrical part 2*a* by a part 2*b* forming a cup and which substantially matches the internal profile 3*a* of the base 3.

The mechanical joining of the casing 2 and base 3 is ensured by means of an elastic ring 5 made integral with the axial support 4 by linking means, for example a snap ring (known under the name of Circlip) 6 arranged in a groove of the support 4.

In accordance with the invention, the elastic ring 5 comprises two substantially ring-shaped, concentric portions 5*a*, 5*b*, one internal the other one external. On this figure, the external diameter of the portion 5*a* is lower than the internal diameter of the portion 5*b*. The external portion is designated by the portion of the greatest diameter.

The internal portion 5*a* surrounds the axial support 4 and is substantially of the same internal diameter as this support. It presses against the snap ring 6 which is housed in the groove. The ring 5 also incorporates a peripheral portion 5*b* which presses against the bottom 2*c* of the casing 2.

According to one important characteristic of the invention, the ring-shaped portion 5*b* incorporates at least one plane part. Here, the whole peripheral portion 5*b* is plane.

Furthermore, portion 5*a*, here, is also plane and portions 5*a*, 5*b* are parallel to each other.

The circular portions 5*a*, 5*b* are made by substantially radial arms 7 forming an angle θ with respect to the plane of said portions 5*a*, 5*b*.

Thus, an axial stress F transmitted to the ring 5 by the base 3 translates into a reaction R parallel to the stress F and substantially perpendicular to the bottom 2*c* of the casing.

There is thus no radial stress exerted on the cylindrical part or on the cup 2*b* of the casing.

The stress transmitted to the bottom 2*c* of the casing may be easily controlled by the dimensioning of the radial arms 7.

It is naturally possible to implement other linking means than the snap ring 6. A nut onto the support 4 may thus be used screwed, with the possible addition of a washer between the nut and the ring 5.

Portion 5*a* may not be plane, for example, but may have a curved or undulated shape.

The plane portion 5*b*, in accordance with the invention, ensures the transfer and optimal distribution of the stress received whilst avoiding any radial stress on the casing.

Figure 3A:
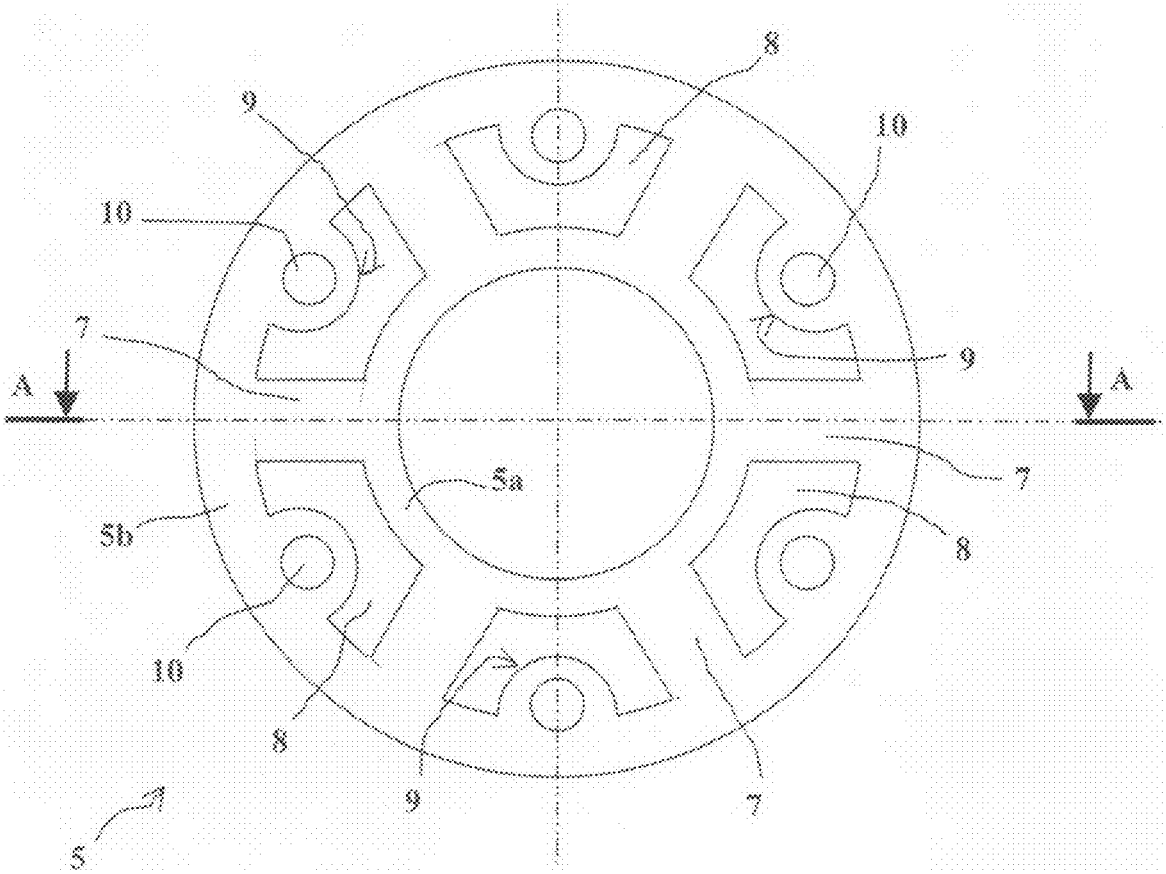
FIGS. 3*a* and 3*b* are two views of a first embodiment of a ring according to the invention, FIG. 3*b* being a section along the plane referenced AA in FIG. 3*a*, FIGS. 4*a* and 4*b* are views of variant embodiments of the ring according to the invention.
Figure 3B:
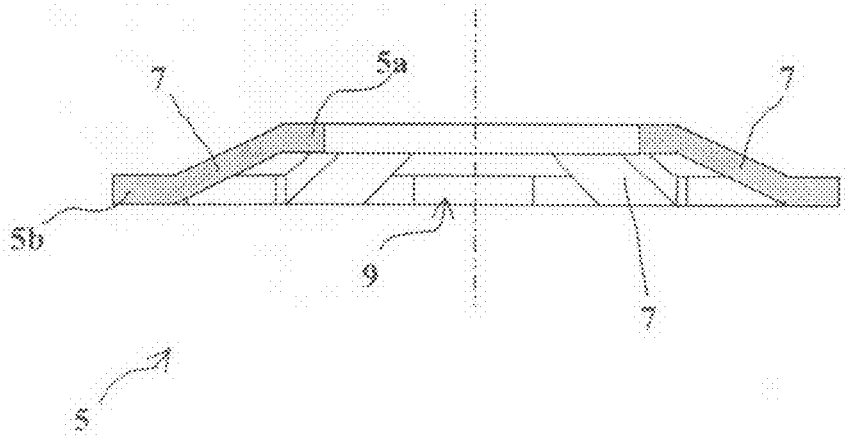

FIGS. 3*a* and 3*b* show a first embodiment of a ring according to the invention.

In this embodiment, the elastic ring incorporates two continuous crowns 5*a* and 5*b*, thus having not slots.

Crowns 5*a* and 5*b* are linked by six arms 7 evenly spaced angularly and an opening 8 is positioned between two consecutive arms 7.

Furthermore, the external ring-shaped portion 5*b* incorporates extensions 9 which extend radially into each opening towards the centre of the ring 5.

These extensions enable the contact area between the ring and the bottom 2*c* of the casing to be enlarged. The stresses thus transmitted are thereby distributed reducing the risk of the casing's shearing.

Each extension 9 is delimited by a substantially circular profile and incorporates a piercing 10. This piercing enables the quantity of unburned material from the casing 2 after firing to be reduced.

This embodiment furthermore enables the stresses to which the combustible casing is subjected to be strongly reduced.

Figure 2:
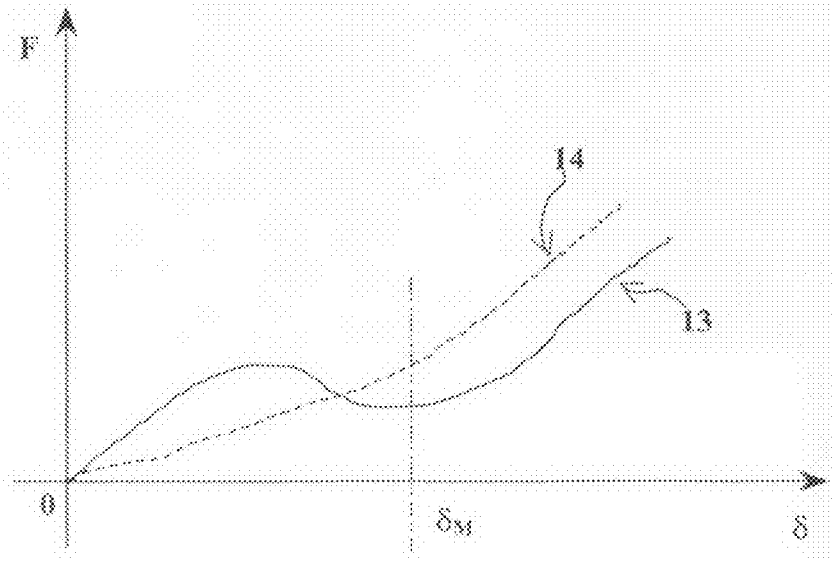
FIG. 2 is a curve giving the stress transmitted by a washer as a function of the relative axial displacements.

FIG. 2 represents a curve 13 characterizing the resistive stress opposed by the ring as a function of the sinking δ of said ring. This sinking δ corresponds to the distance between the planes of each ring-shaped portion 5*a*, 5*b*. We observe that the characteristic of this elastic ring is to oppose relatively moderate stress around a sinking which substantially corresponds to the maximal distance δM separating planes 5*a*, 5*b*.

Such behavior is due to the specific shape of the ring which incorporates two continuous circular portions separated by arms forming springs. Beyond a certain sinking level, this ring approaches a state of mechanical balance which leads to the reduction of the stress.

Using an appropriately dimensioned ring (which someone skilled in the art will easily produce) results in the possibility of holding the casing with respect to the base with minimal stress whilst enabling the relative elastic displacements of the base with respect to the casing.

By way of example, with a spring steel ring of a thickness of 1.2 mm and maximal useful deflection δM=2.5 mm, a retention stress of around 35 deca-Newtons is obtained.

Figure 4A:
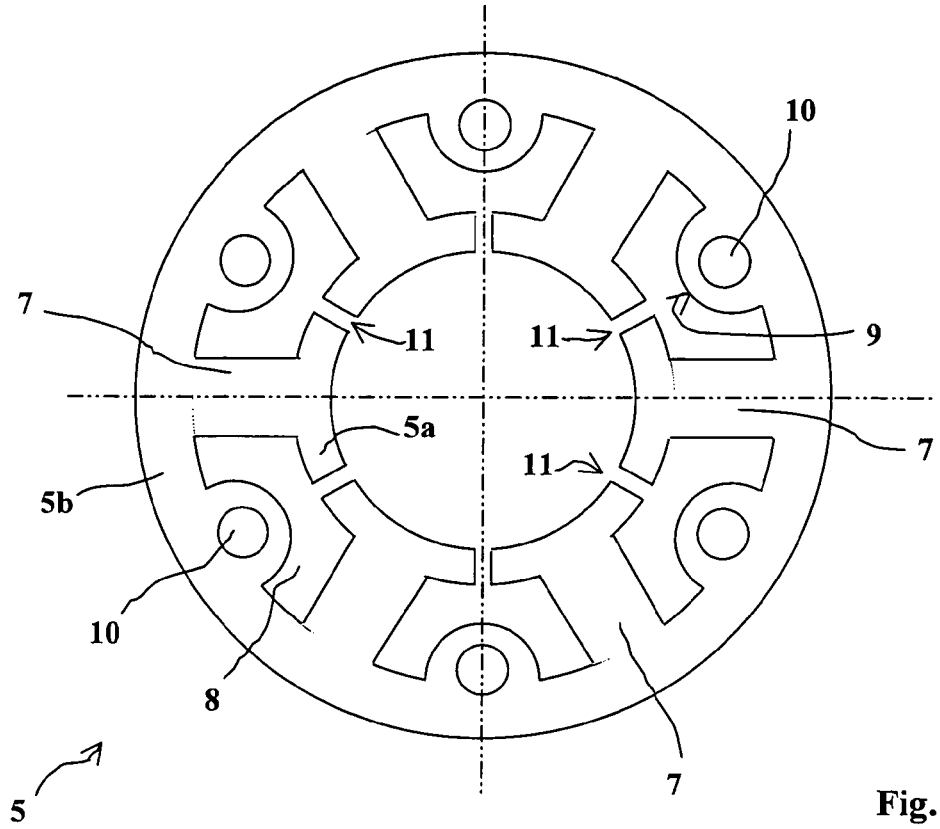
Figure 4B:
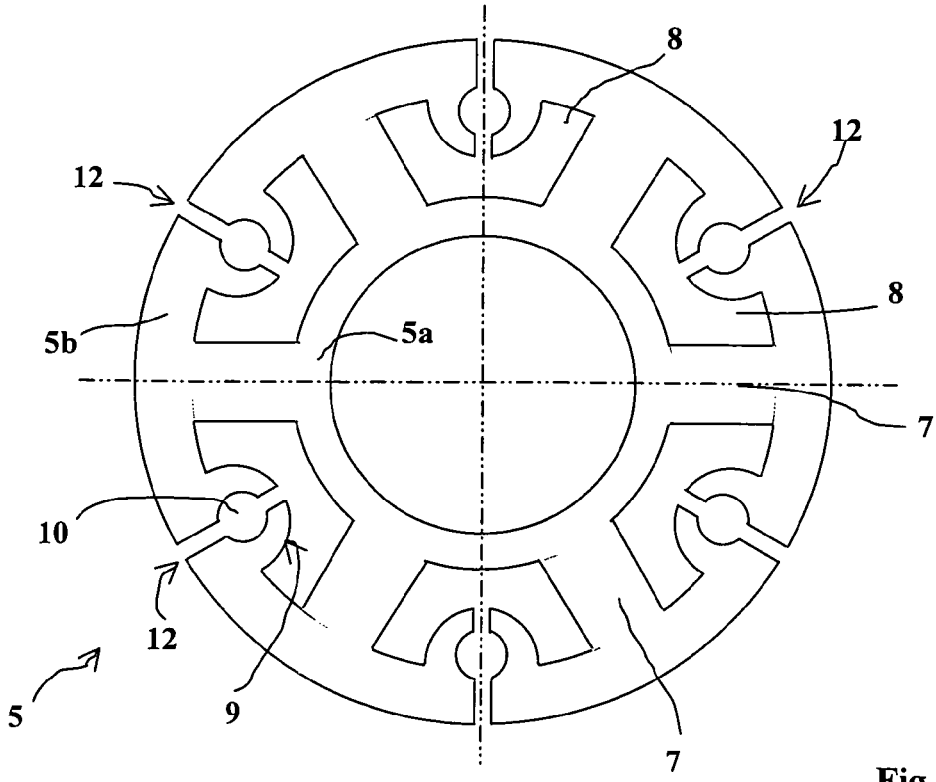

The variants shown in FIGS. 4*a* and 4*b* enable greater flexibility to be given to the ring 5.

According to FIG. 4*a*, slots 11 evenly spaced angularly could be positioned in the internal crown 5*a*, each slot being arranged at an equal distance from two consecutive arms 7.

According to FIG. 4*b*, slots 12 may be made in the external crown 5*b*, such slots being evenly spaced angularly and arranged at an equal distance from two consecutive arms 7. The slots 12 thus cut the different extensions 9.

With these variants, the rigidity and radial deformation of one or other of the crowns is reduced with respect to that observed in the embodiment described with reference to FIGS. 3*a*, 3*b*.

This results in the ring having a deformation characteristic that is different from the previous one. This characterization is given by curve 14 in FIG. 2.

We observe, however, that the stress level for a maximal deflection of 6 mm is relatively moderate (about 100 deca-Newtons).

Figure 5A:
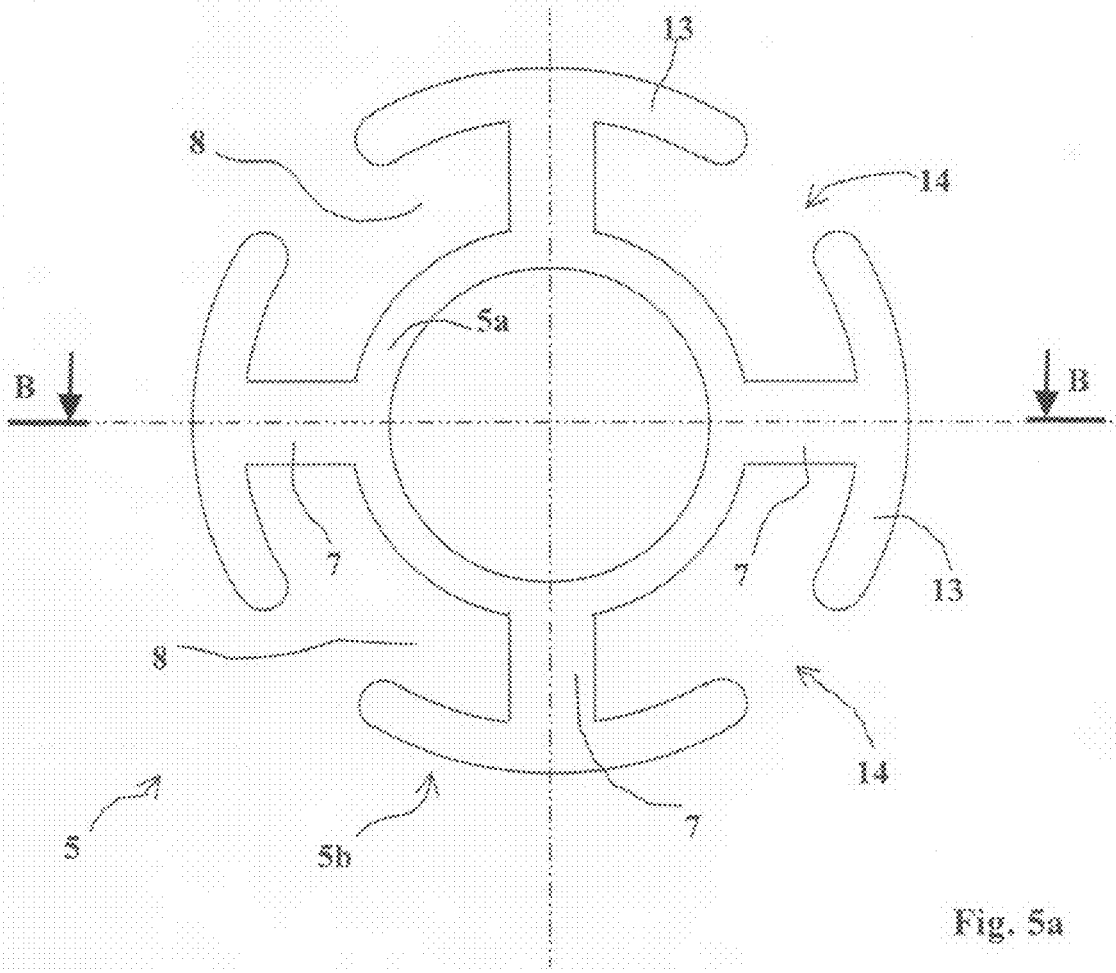
FIGS. 5*a* and 5*b* are two views of another embodiment of a ring according to the invention, FIG. 5*b* being a section along the plane referenced BB in FIG. 5*a*.
Figure 5B:
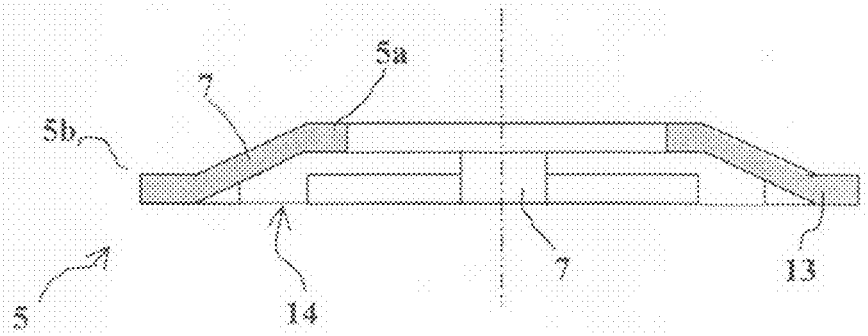

FIGS. 5*a* and 5*b* show another embodiment of the ring according to the invention which is also the preferred embodiment.

In this embodiment, the external crown 5*b* is separated into ring-shaped sectors 13 (here there are four) separated by notches 14 which open into openings 8. Each ring-shaped sector 13 is thus integral with an arm 7 and the sector is symmetrical with respect to said arm.

In a configuration which incorporates four arms 7 and four ring-shaped sectors 13, each sector 13 will have a length of between 15% and 23% of the circumference of the external crown 5*b*. The notches 14 will thus be of a width of between 2% and 10% of said circumference.

The internal crown 5*a* is continuous and may be held on the support 4 by appropriate linking means (snap ring, screwed nut . . . ).

This embodiment of the invention has the advantage of enabling the fully independent deformation of each arm 7. This results in increased flexibility. Furthermore, the stress is here directly proportional to the displacement of each zone under stress and this embodiment enables an amplitude of useful displacement to be obtained that is greater than that obtained with the previous embodiments (approximately 100% additional useful displacement).

Figure 6:
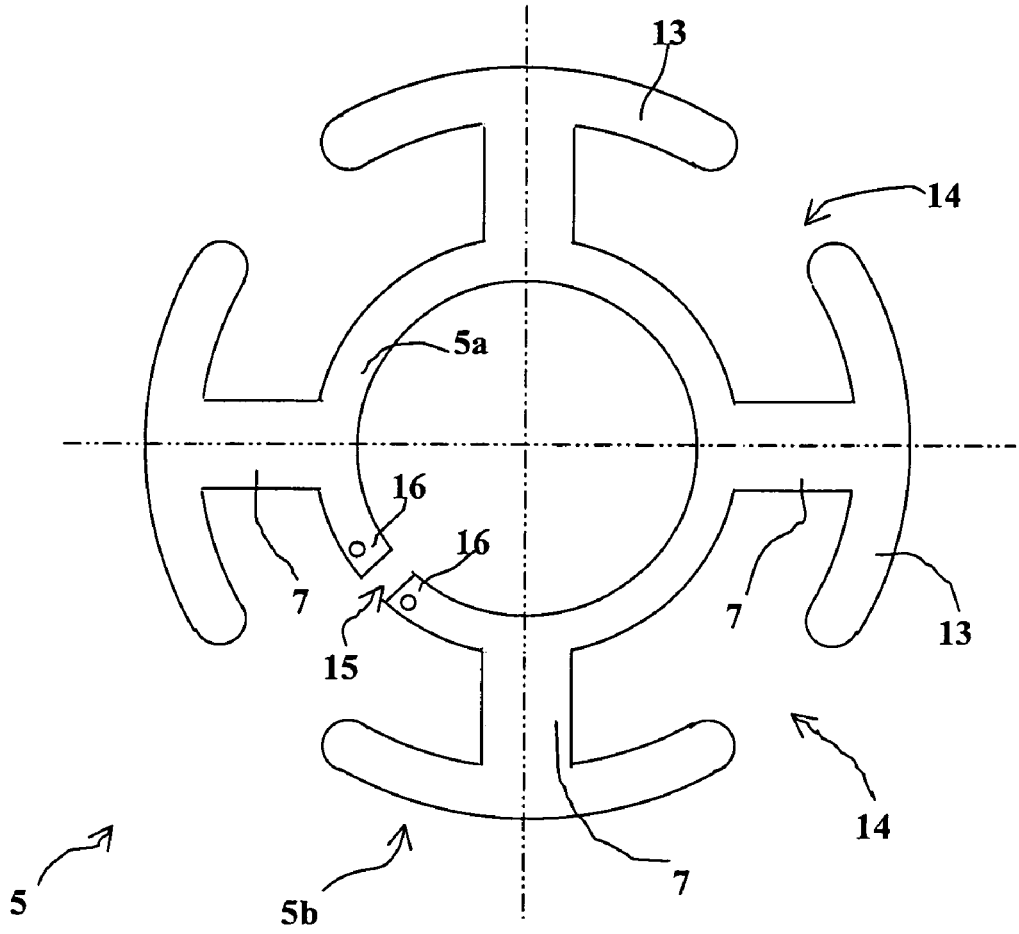
FIG. 6 shows a variant of this embodiment.

FIG. 6 shows a variant of this embodiment in which the internal crown 5*a* has a single slot 15.

Furthermore, the internal crown has a hole 16 on each side of the slot 15. These holes are intended to receive a tool (not shown) enabling the ring 5 to be positioned on the support 4 of the base 3.

By way of a variant, the internal crown 5*a* may be of a width which increases regularly between the slot 15 and a zone diametrically opposite the slot 15.

Thus, the internal crown will be configured like a snap ring or Circlip. It may thus be directly positioned in a groove in the support 4 without it being necessary to provide additional linking means such as the snap ring 6 shown in FIG. 1. Assembly is thereby simplified and the number of parts is reduced.

Figure 7:
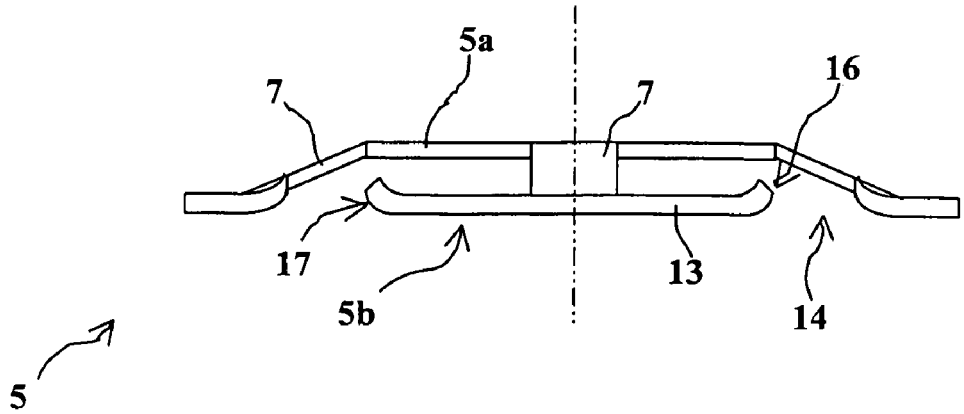
FIG. 7 is a lateral view of another variant embodiment.

Finally, FIG. 7 shows a last embodiment in which each ring-shaped sector 13 incorporates curved extremities 17. This variant has the advantage of avoiding any deterioration or cutting of the bottom 2*c* of the combustible casing by the extremities of the sectors 13 in the event of any relative movement between these elements.

What is claimed is:

1. An elastic retention ring for use with a combustible casing of a piece of ammunition that is held in place by a base, the elastic retention ring comprising:

an internal substantially ring-shaped portion;

an external substantially ring-shaped portion, concentric with the internal substantially ring-shaped portion and having a diameter larger than a diameter of the internal substantially ring-shaped portion; and a plurality of elastic radial arms that link the external substantially ring-shaped portion to the internal substantially ring-shaped portion, wherein the external substantially ring-shaped portion has at least one planar portion contacting a bottom surface of the casing, and the internal substantially ring-shaped portion extending in a plane parallel to the bottom surface of the casing and disposed above the at least one planar portion of the external substantially ring-shaped portion, with the plurality of elastic radial arms connecting the planar portion of the internal substantially ring-shaped portion to the planar portion of the external substantially ring-shaped portion.

2. An elastic ring according to claim 1, further comprising:

a plurality of openings, wherein one opening of the plurality of openings is positioned between two consecutive elastic radial arms, and the external ring-shaped portion incorporates a plurality of extensions extending radially in each of the plurality of openings.

3. An elastic ring according to claim 2, wherein each of said extensions are pierced.

4. An elastic ring according to claim 2, wherein the external substantially ring-shaped portion is provided with a plurality of slots evenly spaced angularly, each slot disposed at a location equal distance from the two consecutive elastic radial arms.

5. An elastic ring according to claim 2, wherein the internal substantially ring-shaped portion is provided with a plurality of slots evenly spaced angularly, each slot disposed at a location equal distance from the two consecutive elastic radial arms.

6. An elastic retention ring for use with a combustible casing of a piece of ammunition that is held in place by a base, the elastic retention ring comprising:

an internal substantially ring-shaped portion;

a discontinuous external substantially ring-shaped portion, concentric with the internal substantially ring-shaped portion and having a combined diameter larger than a diameter of the internal substantially ring-shaped portion; and a plurality of elastic radial arms that link the discontinuous external substantially ring-shaped portion to the internal substantially ring-shaped portion, wherein the discontinuous external substantially ring-shaped portion has at least one planar portion contacting a bottom surface of the casing, and the internal substantially ring-shaped portion extends in a plane parallel to the bottom surface of the casing and disposed above the at least one planar portion of the external substantially ring-shaped portion, with the plurality of elastic radial arms connecting the planar portion of the internal substantially ring-shaped portion to the planar portion of the discontinuous external substantially ring-shaped portion.

7. An elastic ring according to claim 6, wherein the discontinuous external substantially ring-shaped portion is separated into a plurality of ring-shaped sectors, each sector integral with an elastic radial arm.

8. An elastic ring according to claim 7, wherein the internal substantially ring-shaped portion is provided with a slot.

9. An elastic ring according to claim 8, wherein the internal substantially ring-shaped portion has a first hole disposed at a first side of the slot and a second hole disposed at a second side of the slot, the first and second holes together capable of receiving a tool that enables the elastic retention ring to be positioned on the base.

10. An elastic ring according to claim 7, wherein the plurality of ring-shaped sectors incorporates a plurality of curved extremities.

* * * * *